US005352133A

United States Patent [19]

Sampson

[11] Patent Number: 5,352,133

[45] Date of Patent: Oct. 4, 1994

[54] CONNECTOR ASSEMBLY HAVING ANTI-OVERSTRESS LATCH MEANS

[75] Inventor: Stephen A. Sampson, Downers Grove, Ill.

[73] Assignee: Molex Incorporated, Lisle, Ill.

[21] Appl. No.: 93,835

[22] Filed: Jul. 19, 1993

[51] Int. Cl.[5] ..... H01R 13/627

[52] U.S. Cl. ..... 439/357; 439/701

[58] Field of Search ..... 439/350, 352, 353, 354, 439/357, 358, 701

[56] References Cited

U.S. PATENT DOCUMENTS

| | | | |
|---|---|---|---|
| 3,544,951 | 12/1970 | Roberts | 439/358 |
| 4,032,209 | 6/1977 | Rutkowski | 339/91 R |
| 4,938,710 | 7/1990 | Aihara et al. | 439/357 |
| 4,952,172 | 8/1990 | Barkus et al. | 439/532 |
| 4,986,766 | 1/1991 | Leonard et al. | 439/352 |
| 5,104,253 | 4/1992 | Zielinski et al. | 439/357 |
| 5,125,854 | 6/1992 | Bassler et al. | 439/607 |
| 5,190,467 | 3/1993 | Ohta | 439/357 |

*Primary Examiner*—Larry I. Schwartz
*Assistant Examiner*—Hien D. Vu
*Attorney, Agent, or Firm*—A. A. Tirva

[57] ABSTRACT

An electrical optical fiber connector assembly includes a dielectric shroud having a receptacle for receiving a plug connector in position for mating with a complementary connector device. A metal latch is secured to the dielectric shroud and is interengageable with a complementary latch on the plug connector for latching the connector in the receptacle automatically in response to positioning the connector thereinto in a mating direction. An anti-overstress stop overlies the metal latch in a spaced relationship thereto to allow the metal latch to move into and out of engagement with the complementary latch only a limited degree to prevent overstressing the metal latch. A rib and slot engagement is provided between the connector and the shroud to prevent rotation of the connector about an axis perpendicular to the mating direction of the connector, to provide further anti-overstress protection for the metal latch.

9 Claims, 3 Drawing Sheets

CONNECTOR ASSEMBLY HAVING ANTI-OVERSTRESS LATCH MEANS

FIELD OF THE INVENTION

This invention generally relates to the art of fiber connectors and, particularly, to an electrical or optical connector assembly which includes a latching system with anti-overstress means therefor.

BACKGROUND OF THE INVENTION

In various electrical and optical fiber connector assembly applications, a dielectric shroud, such as of plastic material, provides an interfacing means between a connector and a complementary mating connector means. For instance, an electrical or optical fiber cable may be terminated to a connector, and the connector assembly is inserted into the shroud to a position for mating with a plug connector. Usually, the shroud has an integrally molded latch to lock the inserted plug connector in position for mating with the connector assembly.

A problem with connector assemblies as described above involves continuing breakage of the latches, particularly the integrally molded latches. While the plastic latches are of sufficient strength in normal operation to latch/unlatch and to maintain the plug connector in position within the shroud in an axial or insertion direction, excessive rotation of the connector about an axis perpendicular to the insertion direction, with the latch still holding the connector in position, often causes the latch to break. In addition, application of excessive forces to the free ends of the latches in a transverse direction often causes the latches to break.

This invention is directed to solving those problems by providing a new latching system and including various anti-overstress means for the latches.

SUMMARY OF THE INVENTION

An object, therefore, of the invention is to provide a new and improved latching system for a connector assembly which includes a shroud providing an interfacing means between a pair of mating connectors.

In the exemplary embodiment of the invention, the connector assembly includes a dielectric shroud having receptacle means for receiving a plug connector in position for mating with a complementary connector means. Generally, complementary interengaging latch means are provided between the shroud and the plug connector for latching the connector in the receptacle means automatically in response to positioning the connector thereinto in a mating direction.

The invention specifically contemplates that the latch means include a metal latch member secured to the dielectric shroud, the metal latch member being interengageable with a complementary latch device, such as a boss, on the plug connector. As disclosed herein, the shroud is fabricated of plastic material, and the metal latch member is heat staked to the shroud. The metal latch member includes a first planar portion secured to the shroud and a flexible planar tongue portion adapted for snapping into latched engagement with the latch boss on the connector. Reinforcing ribs stiffen the first planar portion.

The invention contemplates the provision of anti-overstress means on the plug connector, engageable with the metal latch member and adapted to allow the latch member to move out of engagement with the latch boss only a limited degree to prevent overstressing the latch member. The anti-overstress means include a portion of the plug connector overlying the tongue portion of the metal latch member in a spaced relationship thereto, thereby allowing limited movement of the tongue portion out of engagement with the latch boss.

The invention also contemplates the provision of a second anti-overstress means between the plug connector and the shroud to prevent rotation of the connector about an axis perpendicular to the mating direction of the connector. In the preferred embodiment of the invention, the second anti-overstress means comprise a slot in the shroud for receiving a projection on the connector as the connector is inserted in the receptacle means of the shroud.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
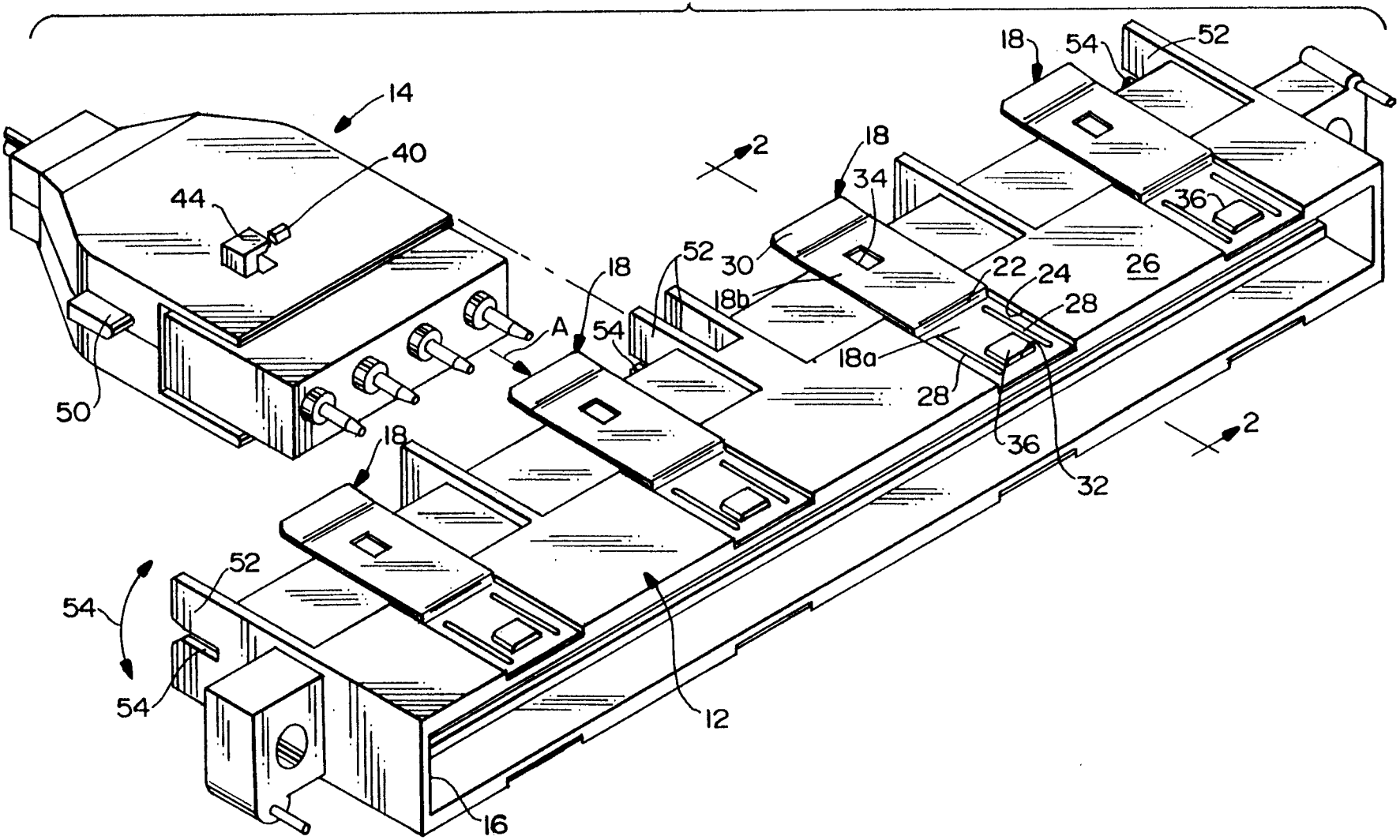
FIG. 1 is a perspective view of a multi-connector shroud, along with one of the connectors insertable thereinto, and incorporating the latch means and anti-overstress means of the invention.

Referring to the drawings in greater detail, and first to FIG. 1, the invention is embodied in a connector assembly, generally designated 10, which includes a dielectric shroud, generally designated 12. The shroud receives a plurality of plug connectors each having terminal contacts, generally designated 14, in a mating or insertion direction indicated by arrow "A". The shroud has a front opening 16 for receiving complementary connector means (not shown) such as a plurality of connector plugs for mating with connectors 14. The shroud mounts a plurality of rearwardly projecting metal latch members, generally designated 18. Generally, as will be described in greater detail hereinafter, metal latches 18 provide complementary interengaging latch means between the shroud and plug connectors 14 for latching the connectors in the shroud automatically in response to positioning the connectors into the shroud in mating direction "A".

Figure 2:
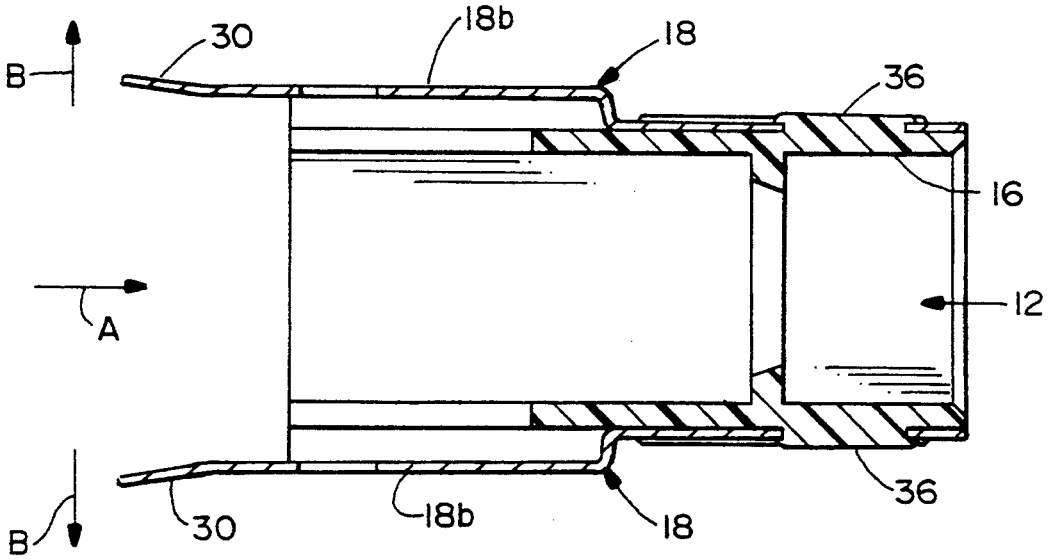
FIG. 2 is a vertical section taken generally along line 2—2 of FIG. 1.

Before going into the details of metal latches 18 and their cooperative interengagement with connectors 14, reference is made to FIG. 2 in conjunction with FIG. 1.

Specifically, although the invention is illustrated herein as incorporated in a multi-connector shroud 12, it should be understood that the invention is equally applicable for incorporation in a shroud for receiving a single connector 14. In addition, as seen in FIG. 2, a pair of metal latches 18 are mounted on the top and the bottom of the shroud for each connector 14. In essence, the shroud is generally hollow to define front opening 16 for receiving the mating connector plugs, with a rearwardly opening receptacle 20 for receiving plug connector(s) 14.

Figure 3:
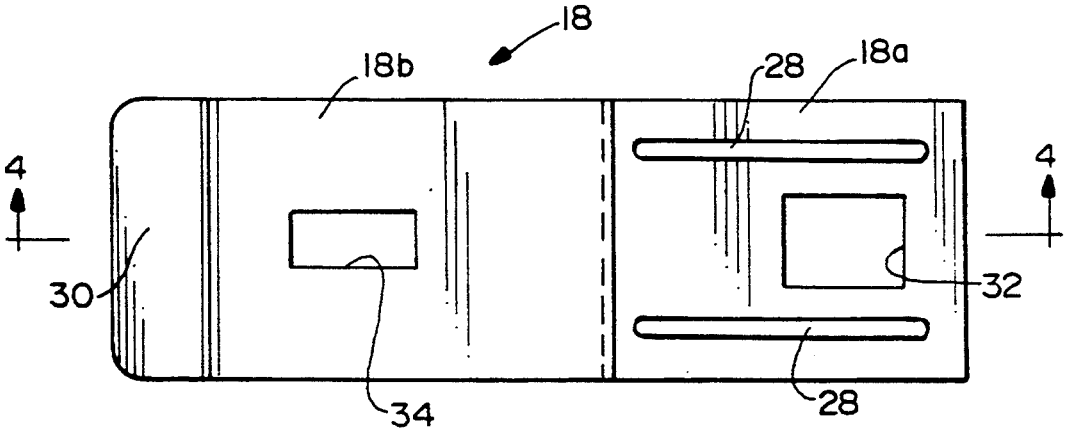
FIG. 3 is a top plan view of one of the metal latch members.
Figure 4:
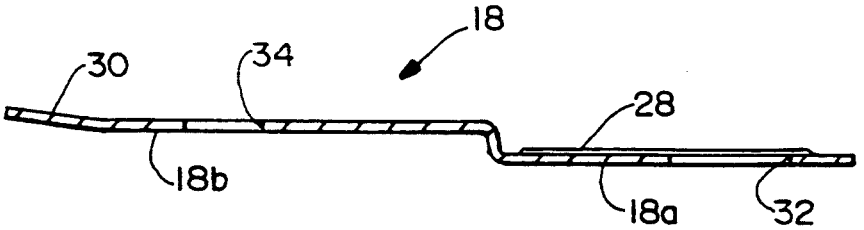
FIG. 4 is a section taken generally along line 4—4 of FIG. 3.

Referring to FIGS. 3 and 4 in conjunction with FIGS. 1 and 2, each metal latch 18 includes a first planar securing portion 18*a* offset, as at 22, from a second planar tongue portion 18*b*. As seen best in FIG. 1, first planar portion 18*a* of each metal latch seats within a complementarily shaped channel or groove 24 in a side face 26 of the shroud. The planar tongue portion 18*b*, being offset at 22, lies in a plane slightly outwardly of face 26. The first planar portion 18*a* includes a pair of integrally formed stiffening ribs 28. The planar tongue portion 18*b* includes a flared end 30 for facilitating guiding connector 14 between the respective pair of metal latches. First planar portion 18*a* includes a securing aperture 32, and planar tongue portion 18*b* includes a latching aperture 34.

More particularly, referring back to FIGS. 1 and 2, it can be seen that plastic material 36 projects upwardly through opening 32 in planar portion 18*a* of each metal latch 18. This plastic material originally was a rectangular boss projecting upwardly through opening 32 when the metal latch was positioned within its respective channel 24. The boss of plastic material then is heat staked to rigidly secure the metal latch within the channel.

Opening 34 in planar tongue portion 18*b* of each metal latch 18 is provided for snappingly engaging a latch boss 40 projecting from connector 14. With a pair of metal latches 18 on the top and the bottom of shroud 12 for each connector 14, the connector correspondingly includes a latch boss 40 on both the top and bottom thereof.

When one of the connectors 14 is inserted into shroud 12 in the direction of arrow "A", latch bosses 40 will engage flared distal ends 30 and bias the metal latches outwardly in the direction of arrows "B" (FIG. 2). When the connector is fully inserted into receptacle means 20, the planar tongue portions 18*b* of the upper and lower metal latches will snap into latching engagement with latch bosses 40, as the bosses register with openings 34 in the tongue portions of the metal latches. As seen in FIG. 2, the shroud has upper and lower interior ribs 42 which define the innermost or inserted positions of the connectors 14. These ribs also define the mated conditions of the complementary plug connectors inserted into front opening 16 of the shroud.

Figure 6:
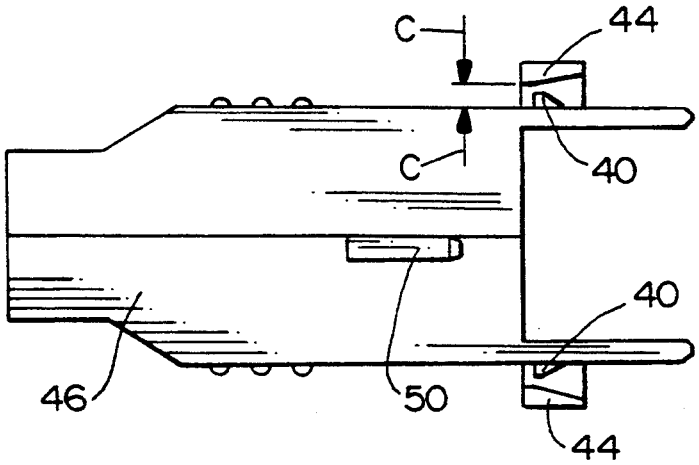
FIG. 6 is a side elevational view of the connector housing.
Figure 5:
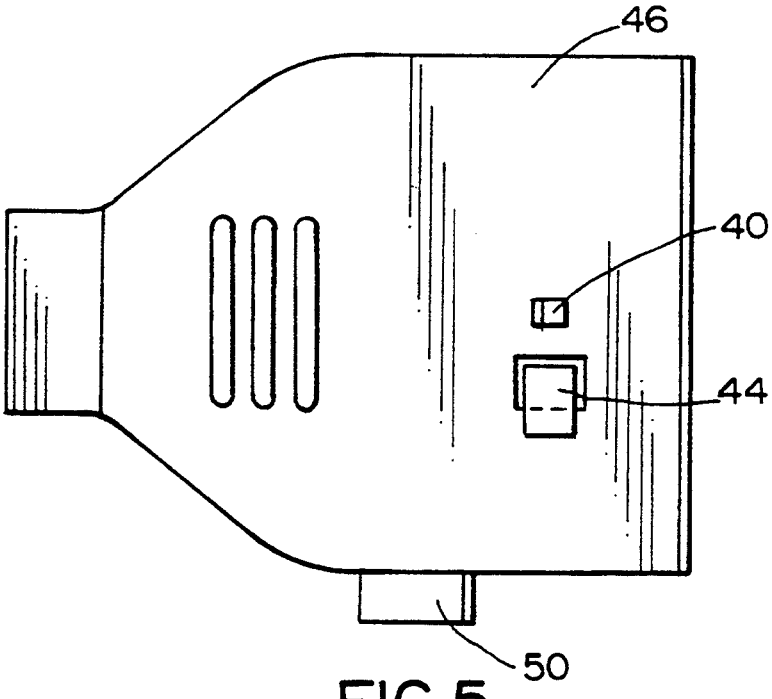
FIG. 5 is a top plan view of the connector housing.

Referring to FIGS. 5 and 6 in conjunction with FIG. 1, the invention contemplates the provision of anti-overstress means on plug connectors 14 to limit outward movement of planar tongue portions 18*b* of metal latches 18. More particularly, an L-shaped stop 44 is formed on the top and the bottom of a housing 46 of each connector 14. As seen best in FIG. 6, one leg of the L-shaped stop 44 is spaced a distance, represented by arrows "C", above the respective top or bottom of the connector housing. This distance is sufficient for receiving an edge of planar tongue portion 18*b* of the respective metal latch under the stop. The distance is sufficient to allow the planar tongue portion to move out of engagement with latch boss 40 but only a limited degree to prevent overstressing of the metal latch member or to prevent destroying the securement provided by heat staked boss 36.

The invention also contemplates a second anti-overstress means between each plug connector 14 and shroud 12 to prevent rotation of the connector about an axis perpendicular to the mating direction "A" of the connector. More particularly, again referring to FIGS. 5 and 6 in conjunction with FIG. 1, each connector housing 46 includes a projection or rib 50 protruding outwardly from at least one side of the connector. As seen in FIG. 1, shroud 12 has at least one rearwardly projecting partition 52 having a slot 54 in position for receiving rib 50 of the respective connector as the connector is inserted into or positioned within the shroud. This interengagement between ribs 50 and slots 54 prevent the connectors from rotating or pivoting in the direction of double-headed arrow "D" (FIG. 1), i.e. about an axis perpendicular to the mating direction "A" of the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a connector assembly which includes a dielectric shroud having receptacle means for receiving a plug connector having terminal contacts in position for mating with a complementary connector means, a plug connector positionable in the receptacle means of the shroud, and complementary interengaging latch means between the shroud and the plug connector for latching the plug connector in the receptacle means automatically in response to positioning the plug connector thereinto in a mating direction, wherein the improvement comprises said latch means includes a metal latch member secured to the dielectric shroud and interengageable with a complementary latch device on the plug connector, and anti-overstress means adjacent to said latch device on the plug connector engageable with the metal latch member and adapted to allow the latch member to move into and out of engagement with the latch device but only a limited degree therefrom to prevent overstressing the latch member.

2. In a connector assembly as set forth in claim 1, wherein said shroud is fabricated of plastic material and has a projection extending from the latch securing surface, and said metal latch member includes an opening to accommodate said projection which heat stakes the latch member to the shroud.

3. In a connector assembly as set forth in claim 1, wherein said metal latch member includes a planar portion said shroud includes a channel to accommodate and secure said planar portion preventing lateral movement of the planar portion with respect to the shroud, the planar portion including reinforcing ribs for stiffening the planar portion.

4. In a connector assembly as set forth in claim 1, wherein said metal latch member includes a first planar portion secured to the shroud and a flexible planar tongue portion adapted for snapping into latched engagement with said latch device.

5. In a connector assembly as set forth in claim 4, wherein said anti-overstress means include a portion of the plug connector overlying said tongue portion in a spaced relationship thereto to allow limited movement of the tongue portion out of engagement with the latch device.

6. In a connector assembly as set forth in claim 1, including second anti-overstress means between the plug connector and the shroud to prevent rotation of the connector about an axis perpendicular to said mating direction of the connector.

7. In a connector assembly as set forth in claim 6, wherein said second anti-overstress means comprise a slot in the shroud for receiving a projection on the connector as the connector is positioned in said receptacle means.

8. In an electrical connector assembly which includes a dielectric shroud having receptacle means for receiving a plug connector having terminal contacts in position for mating with a complementary connector means, a plug connector positionable in the receptacle means of the shroud, and complementary interengaging latch means between the shroud and the plug connector for latching the plug connector in the receptacle means automatically in response to positioning the plug connector thereinto in a mating direction, wherein the improvement comprises said latch means includes a metal latch member secured to the dielectric shroud and interengageable with a complementary latch device on the plug connector, and anti-overstress means adjacent to said latch device between the plug connector and the shroud to prevent rotation of the connector about an axis perpendicular to said mating direction of the connector.

9. In a connector assembly as set forth in claim 8, wherein said anti-overstress means comprise a slot in the shroud for receiving a projection on the connector as the connector is positioned in said receptacle means.

* * * * *